United States Patent [19]

Arai et al.

[11] Patent Number: 4,584,035

[45] Date of Patent: Apr. 22, 1986

[54] STEEL SHEET, AND A PRODUCTION PROCESS THEREFOR, FOR USE IN THE MANUFACTURE OF AN END FOR AN EASY-TO-OPEN CAN: AND AN END FOR AN EASY-TO-OPEN CAN

[75] Inventors: Nobuichi Arai; Hidejiro Asano, both of Kawasaki, Japan

[73] Assignee: Nippon Steel Corporation, Tokyo, Japan

[21] Appl. No.: 590,049

[22] Filed: Mar. 15, 1984

[30] Foreign Application Priority Data

Mar. 22, 1983 [JP] Japan ..... 58-45966

[51] Int. Cl.[4] ..... C21D 9/46; C22C 38/00

[52] U.S. Cl. ..... 148/36

[58] Field of Search ..... 148/12 R, 12 C, 12 D, 148/12 F, 12.3, 36; 75/123 M

[56] References Cited

U.S. PATENT DOCUMENTS 3,777,536 12/1973 Takahasi et al. ..... 148/36

FOREIGN PATENT DOCUMENTS 48913 5/1978 Japan ..... 148/36
20445 6/1978 Japan ..... 148/12 C
1970 1/1980 Japan ..... 148/12 F
24927 2/1980 Japan ..... 75/123 D
62142 5/1980 Japan ..... 148/12 F
97428 7/1980 Japan ..... 148/12.3
57835 4/1982 Japan ..... 148/12 C
57-198244 12/1982 Japan .
52455 3/1983 Japan ..... 148/36
141336 8/1983 Japan ..... 148/12 R
141364 8/1983 Japan ..... 148/36
164752 9/1983 Japan ..... 148/12 R

*Primary Examiner*—Wayland Stallard
*Attorney, Agent, or Firm*—Kenyon & Kenyon

[57] ABSTRACT

The present invention relates to a steel sheet for use in the manufacture of an end for a so-called easy-to-open can, a score being formed on the end.

An object of the present invention is to provide an improved steel sheet which can be used as such end instead of conventional aluminum and which can impart an easy-to-open property thereto. A steel sheet according to the present invention consists essentially of from 0.06% to 0.25% of C, and the balance being essentially Fe and unavoidable impurities, and the cementite particles formed in the steel sheet have an average diameter of from 0.05 μm to 0.5 μm. Since the cementite is fine, the can-opening force can be decreased and the formability of the can end is excellent even at a high strength of the steel sheet.

The present invention also provides an end made of the above-mentioned steel sheet and a process comprising the steps of hot-rolling the steel at an austenite temperature range, cooling a formed steel strip at a cooling rate of 30° C./sec or more and then coiling it at a temperature range of from 450° C. to 620° C., and cold-rolling and recrystallization-annealing at a temperature of 680° C. or less.

7 Claims, 4 Drawing Figures

STEEL SHEET, AND A PRODUCTION PROCESS THEREFOR, FOR USE IN THE MANUFACTURE OF AN END FOR AN EASY-TO-OPEN CAN: AND AN END FOR AN EASY-TO-OPEN CAN

BACKGROUND OF THE INVENTION

1. Field of the Invention

The present invention relates to a steel sheet for use in the manufacture of an end for a so-called easy-to-open can, the steel sheet having an improved property which renders the can easy to open. The present invention also relates to a process for producing such steel sheet and to an end for an easy-to-open can.

2. Description of the Prior Art

In recently widely used easy-to-open cans, such as beer cans, carbonated beverage cans, juice cans, etc., the end of the closed vessel is engraved, i.e., is provided with a score, and a tab is secured on a portion of the end within the score. By pulling off the tab, the score is torn and the can is opened. As the material of the end for easy-to-open cans, i.e., the easy-to-open end, aluminum is, conventionally, more frequently used than are steels since less strength is required to open an aluminum can than a steel can, thereby rendering the can-opening process easier than in the case of steel cans. However, the production of aluminum cans is more expensive than the production of steel cans, and aluminum cannot be used for all types of containers because of its poor corrosion resistance in the case of certain types of contents. In addition, the entire can is desirably made of the same material, e.g., steels, in the light of the recycling of empty cans. Accordingly, there have been strong demands for the development of a steel sheet which exhibits a property rendering a can easy to open which is approximately equal to the easy-to-open rendering property of aluminum.

Generally speaking, since the can-opening property, i.e., the ease with which a can can be opened, depends upon the residual thickness after score working, i.e., the thickness of a steel sheet between the bottom of the score which has an inversed pedestal shape and the rear surface of the steel sheet, the can-opening force is decreased with a decrease in the residual thickness after score working. If, however, the residual thickness after score working is very small, cracks are liable to form during the score working, and, in addition, the score is occasionally damaged during handling of and transportation of the easy-to-open cans. The residual thickness after score working, at which the score can be formed without the formation of cracks, is referred to as the critical residual score thickness and is increased with an increase in the thickness and strength of a steel sheet and the number of coarse intermetallic inclusions. The usual residual thickness after score working is the critical residual score thickness plus a safety margin thickness of from 10 μm to 20 μm. The critical residual score thickness is relatively small, for example, from 60 μm to 70 μm, with regard to non-inner pressure cans for which a thin steel sheet having a thickness of approximately 0.23 mm can be used. With regard to inner pressure cans, a relatively thick steel sheet, e.g., an approximately 0.29 mm steel sheet having a T-4 temper, must be used, and, thus, the critical residual score thickness must be approximately 90 μm or less. In inner pressure cans made of steels, the inferiority of the can-opening property thereof to that of inner pressure cans made of aluminum is greater than that of non-inner pressure cans. In addition, since the steel sheet used for inner pressure cans is thick, the advantage of steels in the light of cost is small. Thus, steel ends for easy-to-open cans are not at all being put to practical use.

Japanese Unexamined Patent Publication No. 57-198,244 discloses that in a steel sheet for use in the manufacture of DI (drawn and ironed) cans the flange working property is improved by refining the size of the cementite particles. The DI cans need not, however, be subjected to score working and rivetting to secure a tab thereon.

U.S. Pat. No. 3,777,536 discloses a steel sheet for use in the manufacture of easy-to-open cans, in which steel sheet phosphorus is incorporated to embrittle and to thus improve the can-opening property thereof.

It is also known to incorporate tin, as an embrittling element, into steels or to coarsen the cementite in the steels, thereby improving the can-opening property. In order to form an end for an easy-to-open can, the end must be rolled around the drum, and a tab must be secured on the end by means of rivetting.

The known methods for improving the can-opening property seriously deteriorate the ductility and, thus, the end-forming property.

SUMMARY OF THE INVENTION

It is an object of the present invention to provide a steel sheet for use in the manufacture of an end for easy-to-open cans, the steel sheet having an improved can-opening property and an end-forming property which is not deteriorated due to the improvement of the can-opening property.

It is another object of the present invention to provide an end for easy-to-open cans, the end having a novel microscopic structure, a high strength, and a small thickness and thereby enabling a reduction in the production cost of easy-to-open cans.

It is a further object of the present invention to provide a process for producing the steel sheet mentioned above, in which process a large amount of fine cementite particles are uniformly dispersed, thereby improving the can-opening property and strengthening the steel.

In accordance with the objects of the present invention, there is provided a steel sheet for use in the manufacture of an end for an easy-to-open can having an improved easy-to-open property, the steel sheet consisting essentially of from 0.06% to 0.25% of C, and the balance being essentially Fe and unavoidable impurities, and the cementite particles formed in the steel sheet having an average diameter of from 0.05 μm to 0.5 μm.

According to a discovery made by the present inventors, the above-described cementite which is present in the steel sheet in particle form promotes the formation of voids when an easy-to-open can is opened. If, however, the average diameter of the cementite particles exceeds 0.5 μm, the cementite is ineffective for decreasing the can-opening force. In addition, if the cementite is excessively coarse, not only is the can-opening force not decreased but also cracks are liable to form during the formation of a steel sheet into an end, scoring of the so-formed end, and the like. On the other hand, when the average diameter of the cementite particles is smaller than 0.05 μm, cohesion between the cementite and the matrix is liable to occur, and, thus, such cementite is not very effective for decreasing the can-opening force.

In accordance with the present invention, there is also provided an end for an easy-to-open can consisting of a steel sheet consisting essentially of from 0.06% to 0.25% of C, the balance being essentially Fe and unavoidable impurities, and the cementite particles formed in the steel sheet having an average diameter of from 0.05 μm to 0.5 μm.

In accordance with the present invention, there is further provided a process for producing a steel sheet for use in the manufacture of an end for an easy-to-open can having an improved easy-to-open property, the process comprising the steps of:

finish hot-rolling a steel which essentially consists of from 0.06% to 0.25% of C, and the balance being essentially Fe and unavoidable impurities, at an austenite temperature range;

after finish-hot-rolling, cooling a formed steel strip at a cooling rate of 30° C./sec or more and then coiling it at a temperature range of from 450° C. to 620° C.;

cold-rolling the hot-rolled steel strip to form a cold-rolled strip; and recrystallization-annealing the cold-rolled sheet at a temperature of 680° C. or less.

DESCRIPTION OF THE PREFERRED EMBODIMENTS

The present invention is now described with regard to the process for producing a steel sheet.

The steel which undergoes the production steps of the present invention contains from 0.06% to 0.25%, preferably from 0.14% to 0.25%, of carbon. When the carbon content is less than 0.06%, the precipitation amount of the cementite is too small to decrease the can-opening force. On the other hand, when the carbon content is more than 0.25%, the steel sheet becomes hard. Therefore, it becomes difficult to produce a steel sheet having an excellent shape, and the formability of the can end is impaired.

The above-described steel preferably contains from 0.05% to 1.0% of manganese and 0.1% or less of aluminum. When the manganese content is less than 0.05%, the strength of the steel is unsatisfactory. On the other hand, if the manganese content is more than 1.0%, the degree of work-hardening during cold-rolling is great, with the result that shape failure of a steel strip is liable to occur. A steel sheet for use in the manufacture of an end for an easy-to-open can can be strengthened by controlling the manganese content, refining the size of the cementite particles, and/or enhancing the reduction of cold-rolling, and such steel sheet can have a strength of from 50 kg/mm$^2$ to 70 kg/mm$^2$.

Aluminum is incorporated, as a deoxidizer, into molten steel. When the aluminum content is more than 0.1%, the deoxidization effects tend to saturate, in addition to the amount of nonmetallic inclusions occasionally being increased.

Phosphorus, silicon, and nitrogen are deemed impurities since phosphorus and silicon exert an adverse effect on the corrosion resistance and since nitrogen can impair the formability of a steel sheet for forming an end. A phosphorus content of 0.05% or less, a silicon content of 0.03% or less, and a nitrogen content of 0.010% or less are preferred.

The steel described above is hot-rolled under a condition which is specified to provide the cementite particles, which are present in the final product, with a fine shape. The predominant structure of the hot-rolled steel strip is a bainite structure and a ferrite structure, which structure contributes to the formation of fine cementite particles in the final product. The specified hot-rolling condition is to: finish-hot-roll the steel at an austenite temperature range; and, after finish-hot-rolling, cool a formed steel strip at a cooling rate of 30° C./sec or more and then coil it at a temperature range of from 450° C. to 620° C.

The hot-rolling must be finished at an austenite temperature range of the steel which has the composition described above. If the hot-rolling is finished at a dual-phase temperature range, in which austenite and ferrite are co-present, the carbon is concentrated in the austenite phase, which has a high solubility limit of carbon, with the result that refinement of the cementite is difficult.

After hot-rolling, the hot-rolled strip must be cooled at a cooling rate of 30° C./sec or higher since at a lower cooling rate the proportion of pearlite, in which the cementite is liable to coarsen, is increased in the structure of a hot-rolled steel strip.

The hot-rolled steel strip is coiled at a temperature of from 450° C. to 620° C. When the coiling temperature is more than 620° C., pearlite is liable to appear in the structure of a hot-rolled steel strip. On the other hand, if the coiling temperature is less than 450° C., the hot-rolled steel strip becomes conspicuously hard so that cold-rolling sometimes becomes difficult.

The hot-rolled steel strip is usually pickled and then cold-rolled and recrystallization-annealed. The type of recrystallization-annealing may be either continuous annealing or box annealing.

The present invention is hereinafter described with reference to the drawings.

BRIEF DESCRIPTION OF THE DRAWINGS

Referring to FIG. 1 and FIGS. 2A and 2B, the average diameter of the cementite particles is 0.2 μm and the average inter-particle distance of the cementite is 0.6 μm in the steel sheet according to the present invention while in the prior art steel sheet the average diameter of the cementite particles is 1.0 μm and the average inter-particle distance is 7 μm.

Dispersion of the fine cementite in a large amount is effective for remarkably improving the can-opening property. In addition, such dispersion is also effective for reducing the amount of solute carbon in the matrix of steel since the solute carbon is liable to be trapped by and around the particles of cementite during cooling after recrystallization annealing. This reduction of the solute carbon is described with reference to FIG. 3, which shows the relationship between the average diameter of cementite particles and the amount of solute carbon in terms of $Q^{-1}$ (snoek peak height). The amount of solute carbon was measured with a torsion-type internal friction tester and then the output of the tester was processed by a computer so as to obtain the amount of solute carbon, which was trace, at a high accuracy. As is apparent from FIG. 3, the amount of solute carbon can be reduced by refining the cementite (data of C=0.1%), and the tendency of the amount of solute carbon to be reduced is promoted when the carbon amount is high (data of 0.1% C relative to data of 0.05% C).

Figure 1:
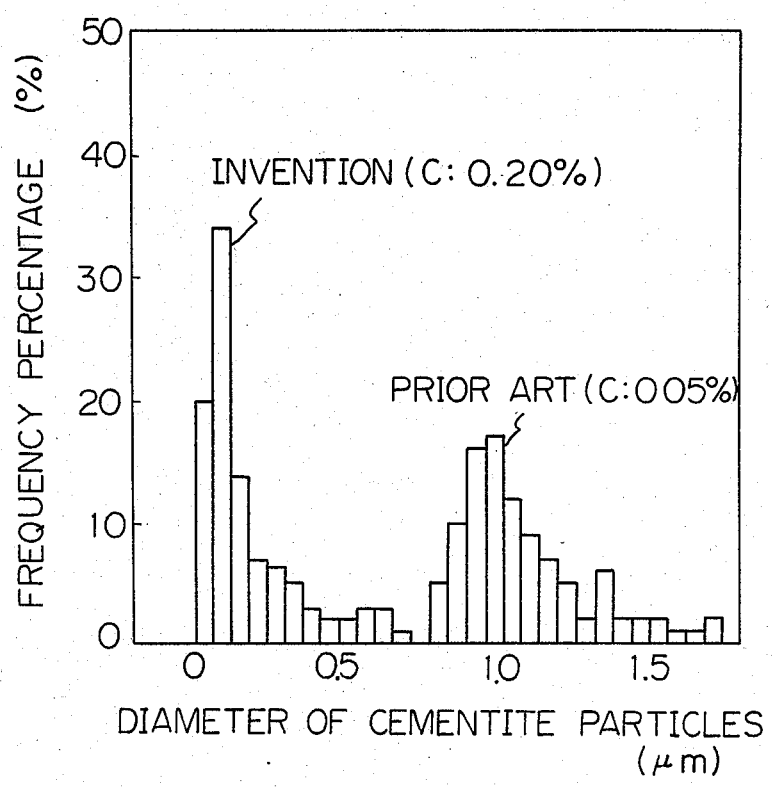
FIG. 1 is a graph which illustrates the dispersion state of the cementite with regard to a steel sheet according to the present invention, in which the carbon content is 0.20% and the cementite is finely dispersed, and an example of the prior-art steel sheets (T-4CA grade), presently on the can market in a very limited amount, which are used for manufacturing a non-inner pressure can. The carbon content of the example of the prior art steels is 0.05%.
Figure 2A:
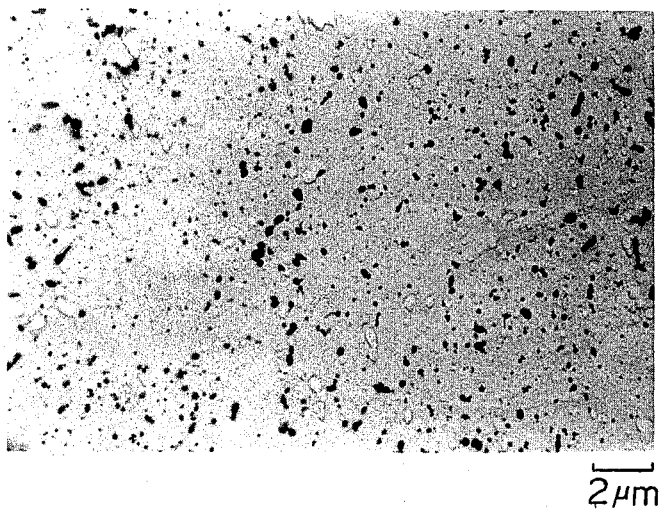
FIGS. 2A and 2B are electron microscopic photographs of extraction replica with regard to the steel sheet according to the present invention and the prior art steel example, respectively, of FIG. 1 and show the morphology of the cementite.
Figure 2B:
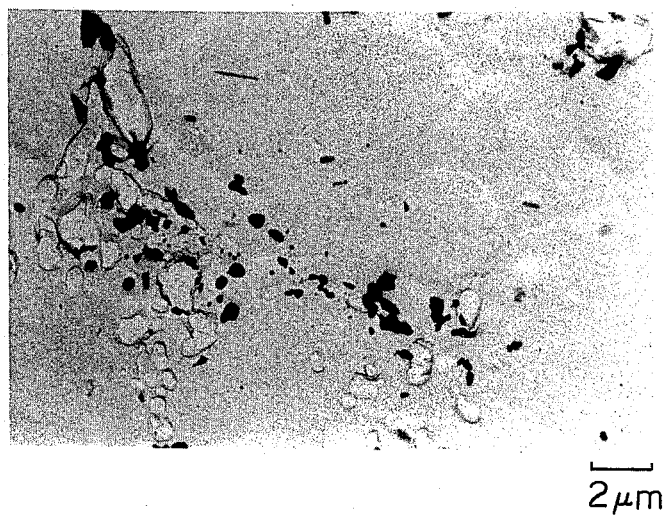
Figure 3:
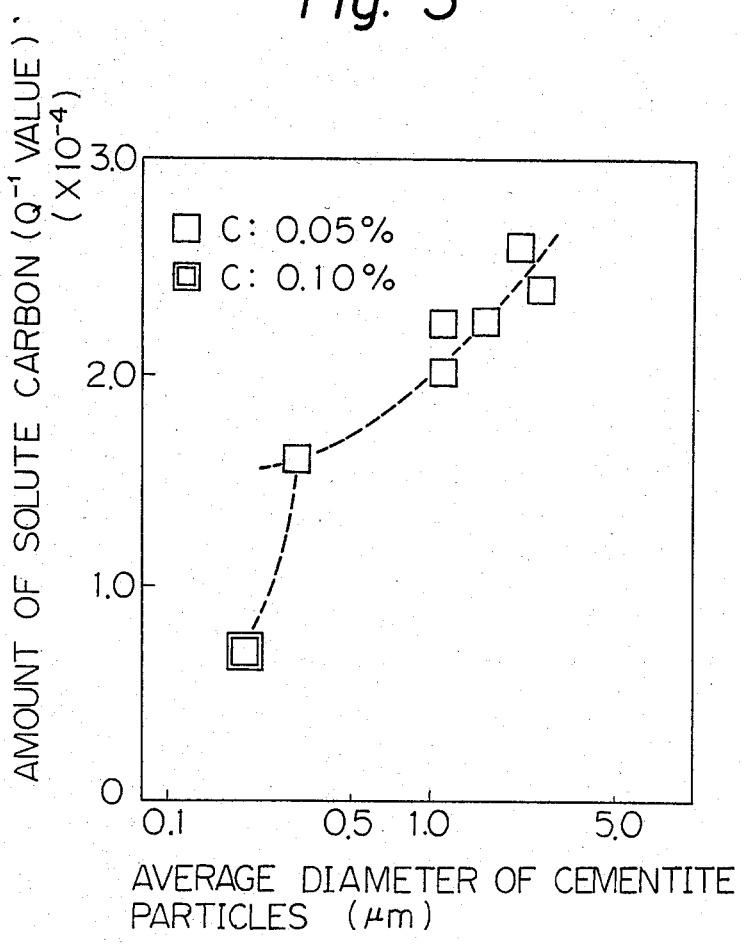
FIG. 3 graphically illustrates that the amount of solute carbon is lessened due to dispersing the fine cementite in a large amount.

As a result of reducing the amount of solute carbon, apparent from FIG. 3, the strength and the ductility are well balanced, and the formability, especially secondary formability- which is required for forming a steel sheet into an end or the like-, is improved in a steel sheet according to the present invention.

After recrystallization-annealing, the steel sheet is subjected, if necessary, to an overaging treatment and temper-rolling, e.g., cold-rolling. The overaging treatment and temper-rolling are conventionally carried out in the production of steel sheets to be formed into DI cans.

The reduction of the cold-rolling depends upon the carbon content of a steel sheet, the contents of cans, the kind of cans, e.g., inner pressure cans and non-inner pressure cans, and the like.

When a high-strength steel sheet is to be produced for use in the manufacture of an end for an inner pressure can, a high reduction in the range of from 3% to 20% is employed for the cold-rolling, and high skin pass-rolling is carried out, thereby obtaining a tensile strength of a steel sheet in the range of from 50 kg/mm$^2$ to 75 kg/mm$^2$. If the tensile strength of a steel sheet is less than 50 kg/mm$^2$, the thickness of the steel sheet becomes great when it is used for manufacturing an end for an inner pressure can, thereby impairing the can-opening property and lessening the cost advantage of the steel. On the other hand, if the tensile strength of a steel sheet exceeds 75 kg/mm$^2$, the end-forming property is impaired. The reduction of the high skin pass-rolling, which is carried out to strengthen the steel, depends upon the steel composition, especially the carbon content. That is, when the carbon content is high, the reduction is small, and when the carbon content is low, the reduction is great. In addition, when the carbon content is 0.14% or more, even a relatively small reduction can provide a high-strength steel sheet. If the reduction is less than 3%, the cold-rolling is not different from the usual skin pass-rolling and is not effective for strengthening the steel. On the other hand, if the reduction exceeds 20%, considerable hardening occurs during skin pass-rolling, thereby occasionally impairing the end-forming property.

The strengthening of steel described above results not in the impairment of but in the guarantee of the end-forming property since an excellent secondary formability is attained in the steel sheet under an annealed state and is maintained after high skin pass-rolling.

The steel sheet according to the present invention may be subjected, if necessary, to a surface treatment, such as Sn plating, Cr plating, or the like.

The present invention is hereinafter described with reference to the Examples.

EXAMPLES

Fourteen aluminum-killed steel sheets A through N were produced. The designation coating amount of tin was #50/50. Ends having an inversed pedestal score and a score residual thickness of 90 μm were manufactured. On each end, a tab was fixed by rivetting. The thickness of the steel sheets was from 0.25 mm to 0.30 mm in the case of the inner pressure cans and 0.21 mm in the case of the non-inner pressure cans mentioned in the table below.

TABLE 1

| Steel Sheets Symbol | | Steel Composition (%) C | Mn | P | Al | N | Si | Average Particle Diameter of Cementite (Dispersion State) (μ) | Hot-Rolling Condition: Finishing Temperature (°C.) | Cooling Rate (°C./sec) | Coiling Temperature (°C.) | Cold Rolling Reduction (%) | Anealing Type: Anealing Temperature × Time | Secondary Rolling Reduction (%) | Sheet Thickness (mm) | Strength (kg/mm²) | Formability of Can End (Cracking Percentage at Rivetting) | Pressure Proofness | Can-Opening Force (Score-Residual Thickness 90 μm): Initial Period of Opening (Pop Value) | Middle Period of Opening (Tear Value) |
|---|---|---|---|---|---|---|---|---|---|---|---|---|---|---|---|---|---|---|---|---|
| A | Invention | 0.093 | 0.28 | 0.013 | 0.05 | 0.003 | 0.012 | 0.4 (uniform) | 880 | 70 | 560 | 90 | box annealing 620° C. × 2 hr | 14 | 0.250 | 66 | good (0%) | good | 2.3 kg | 3.5 |
| B | Conventional | 0.093 | 0.28 | 0.013 | 0.05 | 0.003 | 0.012 | 0.9 (nonuniform) | 880 | 40 | 660 | 90 | box annealing 620° C. × 2 hr | 14 | 0.250 | 64 | poor (70%) | good | 2.7 | 3.8 |
| C | Invention | 0.157 | 0.30 | 0.015 | 0.03 | 0.004 | 0.010 | 0.2 (uniform) | 850 | 60 | 560 | 90 | continuous annealing 660° C. × 30 sec | 10 | 0.250 | 67 | good | good | 1.9 | 3.2 |
| D | Conven- | 0.157 | 0.30 | 0.015 | 0.03 | 0.004 | 0.010 | 0.8 (nonuniform) | 850 | 25 | 640 | 90 | continuous annealing 660° C. × 30 sec | 10 | 0.250 | 65 | poor (100%) | — | — | — |
| E | Invention | 0.200 | 0.30 | 0.013 | 0.03 | 0.003 | 0.011 | 0.15 (uniform) | 850 | 60 | 560 | 90 | continuous annealing 660° C. × 30 sec | 9 | 0.250 | 67 | good | good | 1.8 | 3.0 |
| F | Conventional | 0.200 | 0.30 | 0.013 | 0.03 | 0.003 | 0.011 | 0.8 (nonuniform) | 850 | 25 | 640 | 90 | Continuous annealing 660° C. × 30 sec | 9 | 0.250 | 63 | poor (100%) | — | — | — |
| G | Invention | 0.248 | 0.25 | 0.018 | 0.03 | 0.004 | 0.014 | 0.1 (uniform) | 850 | 50 | 560 | 90 | continuous annealing 660° C. × 30 sec | 3.5 | 0.250 | 62 | good | good | 1.5 kg | 3.9 |
| H | Conventional | 0.248 | 0.25 | 0.018 | 0.03 | 0.004 | 0.014 | 0.6 (nonuniform) | 850 | 25 | 660 | 90 | continuous annealing 660° C. × 30 sec | 3.5 | 0.250 | 60 | poor (15%) | good | 2.1 | 4.1 |
| I | Invention | 0.152 | 0.60 | 0.014 | 0.04 | 0.003 | 0.011 | 0.15 (uniform) | 850 | 60 | 560 | 90 | continuous annealing 660° C. × 30 sec | 9 | 0.250 | 66 | good | good | 1.8 | 3.0 |
| J | Conventional | 0.043 | 0.27 | 0.010 | 0.05 | 0.004 | 0.010 | 0.6 (nonuniform) | 890 | 40 | 600 | 89 | continuous annealing 660° C. × 30 sec | 1.5 | 0.300 | 43 | good | good | 2.8 | 4.3 |
| K | Conventional | 0.043 | 0.27 | 0.010 | 0.05 | 0.004 | 0.010 | 0.6 (uniform) | 890 | 40 | 600 | 90 | continuous annealing 660° C. × 30 sec | 12 | 0.250 | 60 | poor (100%) | — | — | — |

TABLE 1-continued

| Steel Sheets Symbol | | Steel Composition (%) C | Mn | P | Al | N | Si | Average Particle Diameter of Cementite (Dispersion State) (μ) | Hot-Rolling Condition: Finishing Temperature (°C.) | Cooling Rate (°C./sec) | Coiling Temperature (°C.) | Cold Rolling Reduction (%) | Anealing Type: Anealing Temperature × Time | Secondary Rolling Reduction (%) | Sheet Thickness (mm) | Strength (kg/mm²) | Formability of Can End (Cracking Percentage at Rivetting | Pressure Proofness | Can-Opening Force (Score-Residual Thickness 90 μm): Initial Period of Opening (Pop Value) | Middle Period of Opening (Tear Value) |
|---|---|---|---|---|---|---|---|---|---|---|---|---|---|---|---|---|---|---|---|---|
| L | Conventional | 0.093 | 0.28 | 0.013 | 0.05 | 0.003 | 0.012 | 0.8 (nonuniform) | 880 | 20 | 660 | 89 | continuous annealing 660° C. × 30 sec | 1.5 | 0.300 | 45 | good | good | 2.7 | 4.2 |
| M | Invention | 0.093 | 0.28 | 0.013 | 0.05 | 0.003 | 0.012 | 0.3 (uniform) | 880 | 70 | 560 | 91 | continuous annealing 660° C. × 30 sec overaging (400° C. × 30 sec) | 1.5 | 0.210 | 46 | good | (non-inner pressure can) | 1.7 Kg (score-residual thickness 70μ) | 2.8 |
| N | Conventional | 0.093 | 0.28 | 0.013 | 0.05 | 0.003 | 0.012 | 0.8 (nonuniform) | 880 | 20 | 660 | 91 | continuous annealing 660° C. × 30 sec overaging (400° C. × 30 sec) | 1.5 | 0.210 | 44 | poor (5%) | (non-inner pressure can) | 2.1 (score-residual thickness 70μ) | |

The can-opening force was measured at a tensile speed of 50 mm/min by using a tensile tester.

The composition, properties, and production conditions of the steel sheets, as well as the testing results of the cans, are given in the table below.

As is apparent from the table, the steel sheets according to the present invention exhibit a considerably superior end-forming property and rivet-formability to those of the control steel sheets, including the conventional ones.

We claim:

1. A steel sheet for use in the manufacture of an end for an easy-to-open can having an improved easy-to-open property, said steel sheet consisting essentially of from 0.14% to 0.25% of C, and the balance being essentially Fe and unavoidable impurities, and the cementite particles formed in said steel sheet having an average diameter of from 0.05 μm to 0.5 μm.

2. A steel sheet according to claim 1, further containing from 0.05% to 1.0% of manganese and not more than 0.1% of aluminum.

3. A steel sheet for use in the manufacture of an end for an easy-to-open can having an impoved easy-to-open property, said steel sheet consisting essentially of from 0.14% to 0.25% of C, and the balance being essentially Fe and unavoidable impurities, and having a tensile strength of from 50 kg/mm$^2$ to 75 kg/mm$^2$ and the cementite particles formed in said steel sheet having an average diameter of from 0.05 μm to 0.5 μm.

4. A steel sheet according to claim 3, further containing from 0.05% to 1.0% of manganese and not more than 0.1% of aluminum.

5. An easy-to-open end for an easy-to-open can, said end consisting of a steel sheet consisting essentially of from 0.14% to 0.25% on C, and the balance being essentially Fe and unavoidable impurities, and the cementite particles formed in said steel sheet having an average diameter of from 0.05 μm to 0.5 μm.

6. An end for an easy-to-open can according to claim 5, wherein said steel sheet further contains from 0.05% to 1.0% of manganese and not more than 0.1 of aluminum.

7. An end for an easy-to-open can according to claim 6, wherein said steel sheet has tensile strength of from 50 kg/mm$^2$ to 75 kg/mm$^2$.

* * * * *

UNITED STATES PATENT AND TRADEMARK OFFICE

CERTIFICATE OF CORRECTION

PATENT NO. : 4,584,035

DATED : April 22, 1986

INVENTOR(S) : N. Arai, et al.

It is certified that error appears in the above-identified patent and that said Letters Patent is hereby corrected as shown below:

Table 1, "D", change "Con-" to --Con---
"ven-" --ven---
--tional--.

Column 11, line 23, change "impoved" to --improved--.

Column 12, line 12, change "on C," to --of C,--.

Column 12, line 21, change "has tensile" to --has a tensile--.

Signed and Sealed this

Thirteenth Day of October, 1987

*Attest:*

DONALD J. QUIGG

*Attesting Officer*

*Commissioner of Patents and Trademarks*